US005758323A

United States Patent [19]

Case

[11] Patent Number: 5,758,323

[45] Date of Patent: May 26, 1998

[54] SYSTEM AND METHOD FOR PRODUCING VOICE FILES FOR AN AUTOMATED CONCATENATED VOICE SYSTEM

[75] Inventor: Eliot M. Case, Denver, Colo.

[73] Assignee: U S West Marketing Resources Group, Inc., Englewood, Colo.

[21] Appl. No.: 587,125

[22] Filed: Jan. 9, 1996

[51] Int. Cl.[6] ..... G10L 3/00

[52] U.S. Cl. ..... 704/278; 704/270; 705/26; 379/67; 379/88

[58] Field of Search ..... 395/2.87, 2.79, 395/2.22, 2.67, 2.76, 226, 227; 379/67, 68, 71, 88; 704/278, 270, 213, 258, 267; 705/26, 27

[56] References Cited

U.S. PATENT DOCUMENTS

| | | | |
|---|---|---|---|
| 4,785,408 | 11/1988 | Britton et al. | 395/2.79 |
| 5,283,731 | 2/1994 | Lalonde et al. | 395/226 |
| 5,384,893 | 1/1995 | Hutchins | 395/2.76 |

*Primary Examiner*—Kee M. Tung

*Attorney, Agent, or Firm*—Brooks & Kushman; Judson D. Cary

[57] ABSTRACT

A method for producing a voice file for use in an automated concatenated voice system. The words and phrases to be used in the system are scripted in a staged script, and read by a voice talent. The recording of the staged script as read by the voice talent is processed and edited to produce a plurality of naturally sounding words and phrases which may be concatenated into voice messages. The edited words and phrases are stored in a composite voice file for use by an automated concatenated voice system.

17 Claims, 2 Drawing Sheets

SYSTEM AND METHOD FOR PRODUCING VOICE FILES FOR AN AUTOMATED CONCATENATED VOICE SYSTEM

TECHNICAL FIELD

The invention is related to automated concatenated voice systems and, in particular, a method and system for producing a voice file from which naturally sounding concatenated messages can be generated.

BACKGROUND

Electronic classified advertising is currently being used to augment printed classified advertising such as found in newspapers, magazines and even the yellow page section of the telephone book. Electronic classified advertising is intended to allow the sellers of goods and services to solve many needs that are currently unmet by printed advertisements. Further electronic classified ads can give a potential user more detail about the product or services being offered than is normally found in a printed ad. As a result, the buyer is able to obtain additional details without having to talk directly to the seller. These electronic ads can be updated frequently to show changes in the goods and services being offered, improvements in the good and services being offered, changes in cost and the availability of the goods and services.

Existing electronic classified advertising systems have thus helped sellers to sell their goods and services and buyers to locate the products and purchase the same. However, existing electronic advertising systems using voice message systems must be fully understandable by the potential user and preferably presented in a relatively standardized format so as to avoid confusion or misunderstanding.

The invention is a method for generating a voice file from which naturally sounding voice advertisements can be generated.

SUMMARY OF THE INVENTION

One object of the invention is a system and method for generating a voice file from which natural sounding concatenated voice messages can be made.

Another object of the invention is to generate scripted scripts from which individual words and phrase can be edited to form a multitude of voice files.

Still another object of the invention is to produce sound recordings of the staged script from which the desired words and phrases are to be edited.

Yet another object of the invention is to process the recorded staged script to guarantee that each desired word and phrase to be stored in the voice file has the same amplitude.

Still another object of the invention is the identification of the new words and phrases to be entered into the voice file, scripting a staged script containing the new words and phrases in real sentences and in the syntactic position as they would occur in a voiced message and recording a reading of staged script. The recording of the staged script is processed to increase clarity then edited using predetermined rules to isolate and to assign an identification number. The new words and phrases edited out of the recording are tested then loaded into the voice file.

These and other objects of the invention will become more apparent from a reading of the detailed description of the invention in conjunction with the appended drawings.

BEST MODE FOR CARRYING OUT THE INVENTION

Figure 1:
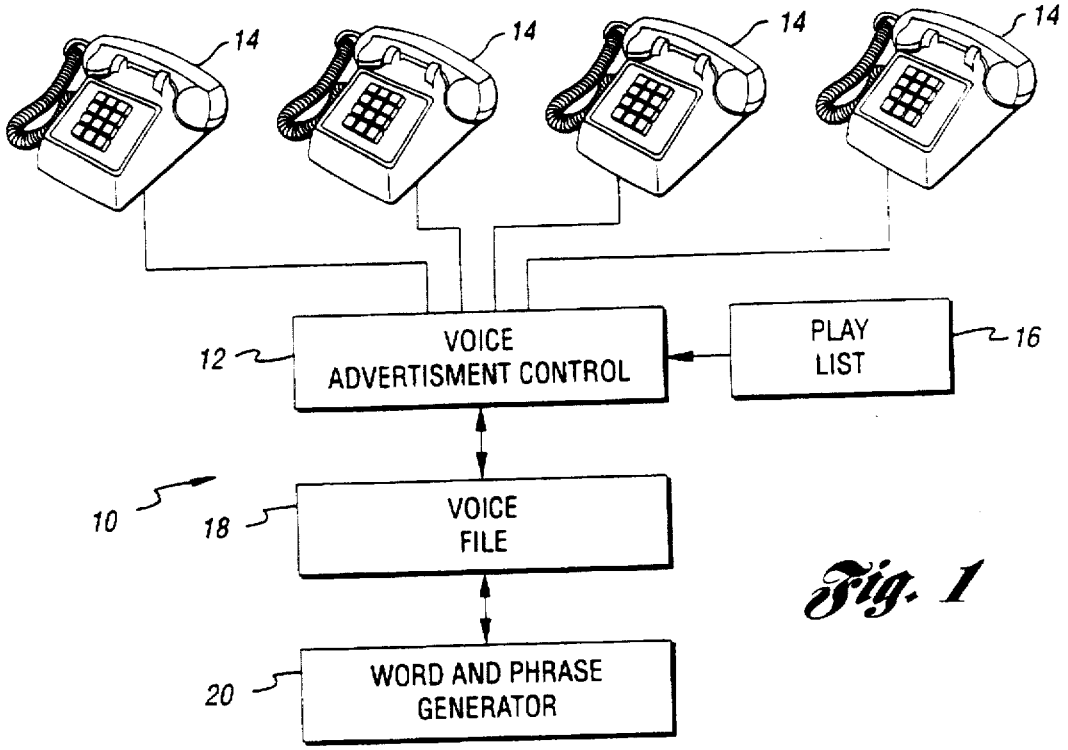
FIG. 1 is a block diagram of a voice advertisement system having a voice file and a word and phrase generator.

FIG. 1 shows the basic components of a voice advertisement system 10 having a Voice Advertisement Control 12 which may be accessed by potential buyers by means of telephones 14 to select and listen to one or more of the advertisements stored in a Play List 16. The Play List 16 contains the information required to playback to the potential buyer the goods and services which the seller or provider wishes to make known to the general public. For example, the advertisements may be related to homes for sale, used cars for sale, home builders, plumbers, or any other category as may be found in the printed classified ad section of a newspaper or similar publication. The Play List contains pointers into a Voice File 18 containing the voiced words and phrases required for a voice playback of each particular advertisement. Voice File 18 may be a plurality of individual voice files or a composite voice file. The Voice Advertisement Control 12 using a concatenation process will concatenate the identified words and phrases to produce a voice playback of the identified advertisement or advertisements.

The voiced words and phrases stored in the Voice File 18 are generated by a Words and Phrases Generator 20.

In operation, voiced words and phrases that are used in the Voice File 18 are generated by recording a voice talent (a human person) reading a staged script, edited, and assigned an identification number by the Words and Phrase Generator 20 then placed in the Voice File 18.

When a supplier of goods or services wants an ad placed in the Voice Advertisement System, the content of his add is entered into the Voice Advertisement Control 12 and the ad is constructed using the words and phrases contained in the Voice File 18 given an identification number then placed in the Play List File 16.

A potential buyer accesses the Voice Advertisement Control 12 using a conventional telephone 14. To prevent the buyer from having to listen to all of the ads available in the Play List 14, the buyer can input key search criteria on their touch-tone telephone keypad and listen to only those advertisements that meet their criteria. Examples of search materials for used automobiles are: vehicle make, model year, and type, i.e. 2-door, 4-door, van, convertible, etc. For homes or rentals, the search material may include the number of bedrooms, number of bathrooms, neighborhood and price range.

In response to the criteria input by the potential buyer, the Voice Advertisement Control 12 will interrogate the Play List 16 to locate each voice advertisement meeting the buyer's criteria and transmit each voice advertisement to the user one at a time. The Voice Advertisement Control 12 may also permit the buyer to skip portions of the voice advertisement or have one or more of the voice advertisements played back if so desired.

After all the advertisements meeting the potential buyers criteria have been played back to the potential buyer, the Voice Advertisement Control will so inform the potential buyer and ask if there is any search he wishes executed.

In order to properly voice the advertisements, the words and phrases stored in the Voice File 18 preferably are voiced in the same syntactic position as they will be used in the voiced advertisement. To accomplish this, these words and phrases are generated by the words and phrase generator 20. The details of the Words and Phrases Generator 20 are shown in FIG. 2 and its operation is discussed relative to the flow diagram shown in FIG. 3.

Figure 2:
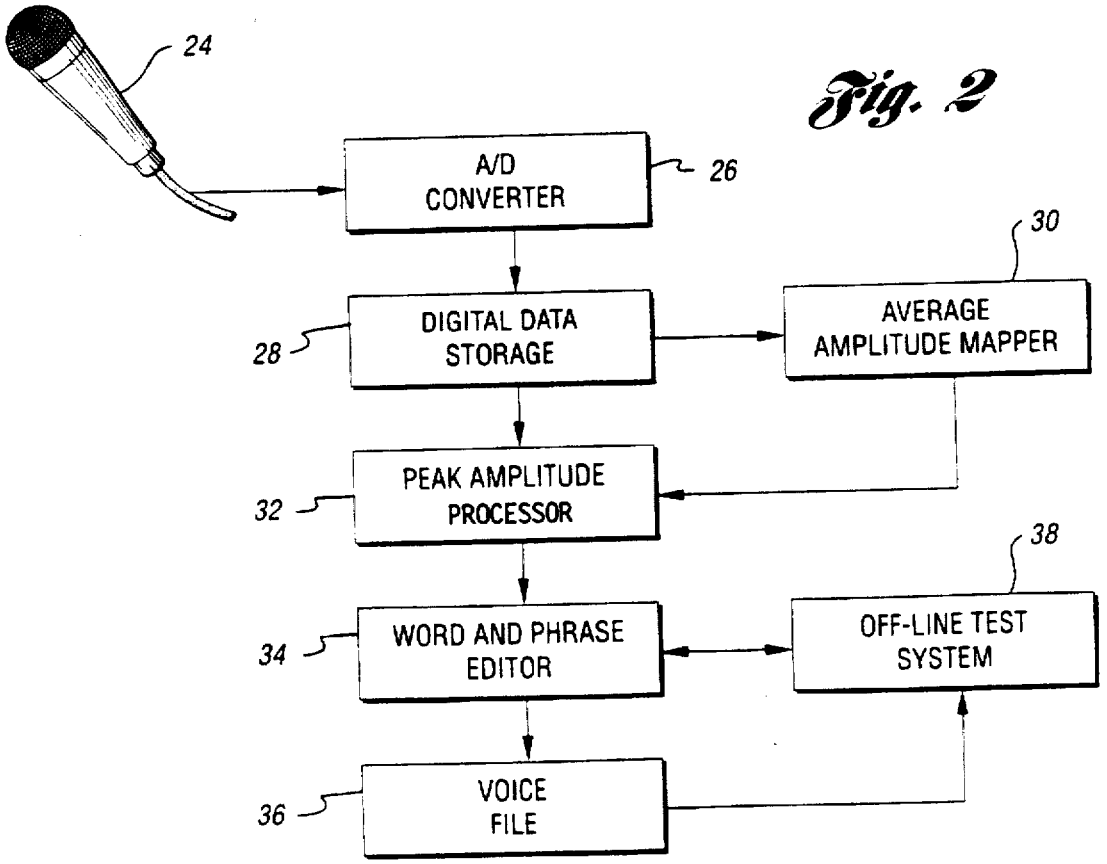
FIG. 2 is a block diagram of the word and phrase generator for producing voiced words and phrases for the voice files of the voice advertisement system.

Referring first to FIG. 2, the words and phrases Generator 20 includes a microphone or other voice to electrical signal generator 24. A voice talent, i.e. a human person, naturally reads a scripted fake or staged advertisement containing the desired words and phrases in their desired syntactic positions including all proper voice inflections. The microphone 24 converts the voice signals into corresponding analog electrical signals which are converted to digital voice data by an analog to digital (A/D) convertor 26. The digital voice data is temporarily stored in a digital data storage 28. The amplitude of the digital voice data temporarily stored in the digital data storage 20 file is mapped by an average amplitude map generator 30 to generate an average amplitude of the stored digital voice data.

A peak clamping processor 32 compresses in a special way the digital voice data stored in the digital data storage such that each word is at the same amplitude as all the other words. This will guarantee that the recordings of every word and every phrase will match any phrase that may be played back before and after it during the playback to the potential buyer.

After the digital voice data is compressed, the desired words and phrases to be stored in the Voice File 18 are marked and given an identification number. This process is partially performed by a human operator listening to the audible sounding of the word or sound while observing the digital representation of the sound. The audited portions of the words and phrases are then used in an off-line test system 38 together with words and phrases previously stored in the Voice File 18 to be sure they can be concatenated together to produce a natural sounding voice advertisement. After passing this test, the edited words and phrases are stored in the Voice File 18.

Figure 3:
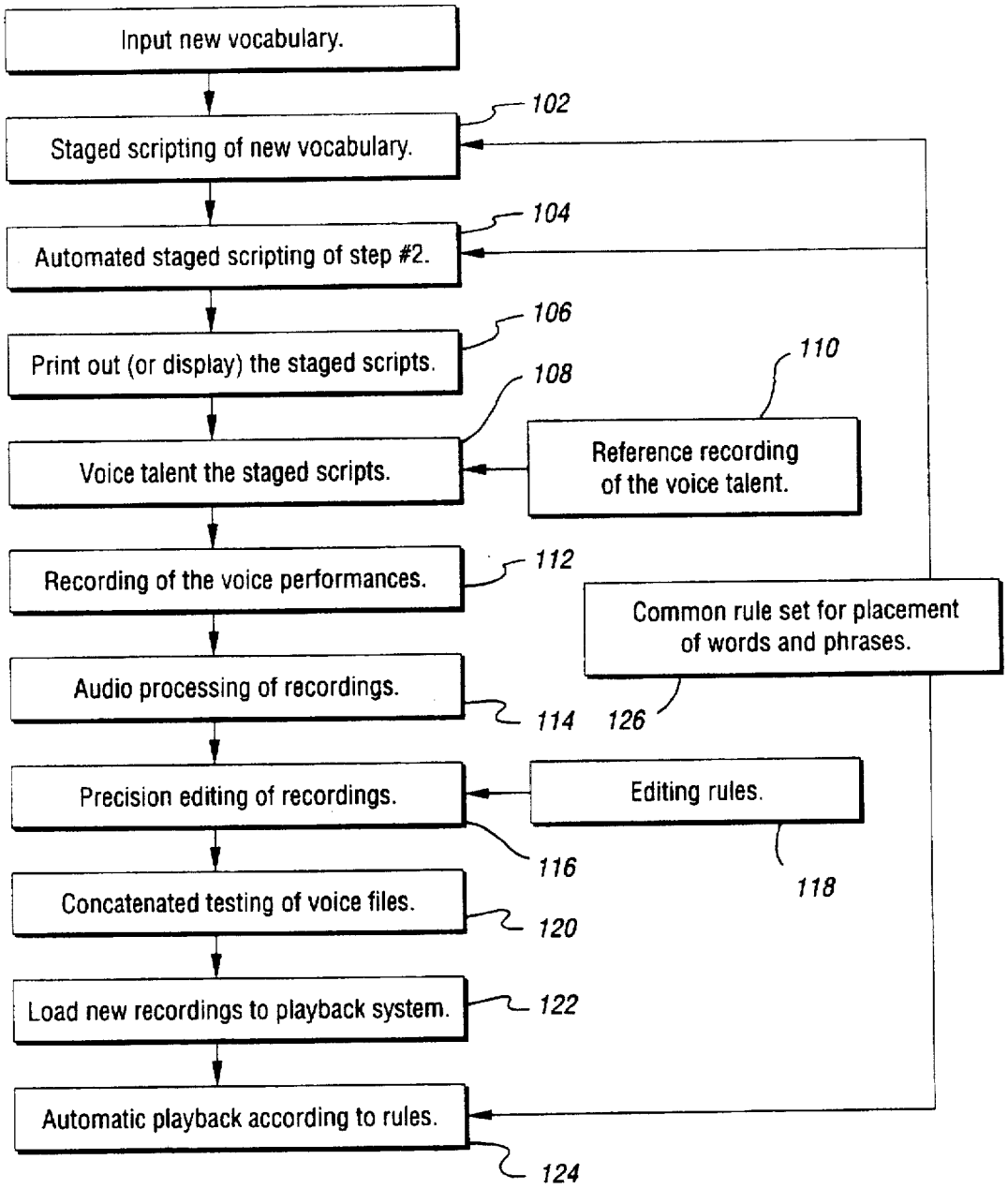
FIG. 3 is a flow diagram of the method for generating the words and phrases to be stored in the voice file.

The operation of the Voice File Generator 22 will now be discussed relative to the flow diagram shown on FIG. 3. The generating of the words and phrases begins with the input of new vocabulary, block 100, to be included in the Voice File 18. This step sets a flag identifying the new words and new phrases that need to be recorded. The method then proceeds to prepare a staged scripting, block 102. This step formats the new words and phrases into real sentences inside of a fake or staged script so the voice talent can read the scripted words and phrases naturally. The actual meaning or the content of the staged script is of no concern as long as the grammar matches the final playback. After the staged scripting of the new words and phrases, the script is automatically staged using a computer as indicated by block 104, then is printed out as indicated by block 106. In the latter step, the automated script is either printed out in a format readable by the voice talent or displayed on a video display screen.

The voice talent then practices reading the staged script, as indicated by block 108, to optimize the reading of the script. Reference recordings of the voice talent reading the script are made, block 110, then played back to the voice talent to stabilize the vocalization of the new words and phrases to be recorded. The voice talent reads the staged script under controlled reading conditions and pays close attention to the edit points, to make sure the performance is natural, that proper voice inflections are used, and that the performance is editable.

After the reading of the staged script is perfected by the voice talent, a recording of the voice talent reading the script is made as indicated by block 112. During this recording, every attempt is made to have to voice talent comfortable, in the same relative position to the microphone as with the recording of the other scripts, and relaxed. This reading of the script voices all the words and phrases need to be stored.

After the readings are recorded, the composite readings are processed, block 114, to increase clarity of the voiced words and phrases. In this processing, the recordings are compressed to guarantee that each word and each syllable is at the same amplitude as all other words in the recording. This guarantees that all the new words and phrases of the recording will match each phrase that might be played back before or after it.

A digital system makes this final compression to guarantee that no drift will occur for the compression target level or compression levels. Peak amplitude clamping is used for this compression such that any peak amplitude in a given range will be adjusted to the same level. To assure that no over shooting during the compression occurs, a map of all of the amplitude statistics of the recorded digital voice data is made, then the peak amplitude clamping of the internal elements of the recorded digital voice data is made knowing what the sound level will be doing before the sound does it. In other words, the modulation of gain is close to perfect.

One side effect of peak amplitude clamping is that if the breath sounds from the voice talent gets close to the target amplitude, then the breath sounds are brought to the same level as any other part of the speech. FM radio announcers generally have this same type of affect occur because of the heavy compression used to make the announcer's voice sound fuller. However, there is nothing a radio announcer can do about this problem because their broadcast is live. In contrast, this problem for generating the words and phrases can be dealt with off-line as shall be explained later.

After the digital voice data of the recordings are processed, the voice data is precision edited, block 116. In this precision editing, each new word or phrase needs to be located and edited out of the recording and assigned an identification number so that the Voice Advertisement Control 12 can locate the words and phrases in the Voice File 18 as required.

The edit points could also be indexes into one large sound file to indicate the beginnings and ends of each individual word and phrase.

Certain rules are used for editing of the recordings of the digital voice data as follows:

Rule 1: If a phrase required to be isolated for concatenation is long enough so that the voice talent needs to take a breath in the middle of the phrase, then the breath sound is retained but the level of the breath sound is reduced to at least 12 dB to retain the naturalness of the recording. This reduction in the level of the breath sound compensates for the peak amplitude clamping of the breath sounds as discussed relative to processing of the recordings, block 114. The retention of the breath sound leaves a sufficient amount of digital voice data in the edited phrase to keep half duplex systems, such as speaker phones, from switching off the speaker at buyer end of the system.

If a faster playback is required so as to pass more information to the potential buyer at a faster rate, the breath sounds can be completely cut out of the phrase being edited joining the sounds before the breath sound to the sounds after the breath sound.

Rule 2: Every edit should be made in the least conspicuous place.

Rule 3: Every edit should be made as close as possible to a zero crossing of the sound wave.

Rule 4: Every edit should be made outside of the active portion of the sound, except in special cases. If an edit is required in the active portion of a sound file, such as a beginning or ending "M" or "N" sound, then a unified standard is applied. Any edit from the end of one sound file to the beginning of the next sound file must attempt to keep a normal continuation of the velocity of the sound wave.

Therefore (a) all beginnings of recordings if cut in an active wave should be at a zero crossing and going in a direction from zero to a positive value; and (b) all endings of recordings, if cut in an active wave, should be at a zero crossing and going in a direction from negative towards zero.

This results in the concatenation of two words or phrases that were cut in an active portion of the sound, to be played back with a minimum of distortion or perception.

It is obvious that the same result would be obtained if rules 4(*a*) and 4(*b*) were reversed. For example, if 4(*a*) were reversed, the active wave would be cut at a zero crossing when the active wave was going in a direction from negative value to zero and if 4(*b*) was likewise reversed, the active wave would be cut at a zero crossing with the active wave going in a direction from the zero crossing to a positive value.

Rule 5: Every edit should be made approximately 0.02±0.005 seconds before the start of the isolated word or phrase. However, for words and phrases beginning with "fricative" sounds, such as an "f" or an "s", any edit should be made approximately at the beginning of that fricative sound. Rules 2, 3, and 4 above also apply to words and phrases beginning with "fricative" sounds.

Rule 6: Any edit should be made approximately 0.02±0.005 seconds after the end of an isolated word or phrase. For words and phrases ending with fricative sounds, the edit should be made approximately at the ending of the fricative sound. Rules 2, 3, and 4 also apply to editing words and phrases ending with fricative sounds.

Testing of the new words and phrases, indicated by block 120, is conducted with an off-line test system that concatenates the new words and phrases together with words and phrases previously stored in the Voice File 18. The concatenated words and phrases are listened to in a situation as they will be used in the automated concatenation voice system. Upon verification that the new words and phrases can be concatenated with the words and phrases currently stored in the Voice File 18, the new words and phrases are loaded into the Voice File 18 and the Voice Advertisement Control 12 will clear flags identifying that the new words and phrases are ready for use.

The final step, block 124, is the automatic playback using the new words and phrases along with the previous words and phrases loaded into the Voice File 18. The Voice Advertisement Control 12 automatically concatenates the newly generated words and phrases with the words and phrases previously stored, to produce a desired voice advertisement. This playback constrains the way words and phrases stored in the Voice File 18 can be assembled. The words and phrases are assembled in accordance with the common set of rules 126 as applied to the steps discussed above relative to blocks 102 and 104. The automated concatenated playback closes the loop of vocal performance and automatic playback of the vocal advertisements.

In the generation of the fake or staged advertisement to be read by the voice talent and recorded, all of the new words and phrases required to be generated must be placed in their respective syntactical position as they will be used in the advertisement. The use of a staged advertisement for the generation of the words and phrases assures that the vocal words and phrases to be generated have universal applicability and are not limited for use to a single voice advertisement. As indicated above, this is verified by the automatic playback, block 124, of an and actual voice advertisement. A typical staged ad to be recorded relating automobile advertisements is as follows:

"1993 Edsel convertible, runs great, one of a kind, great work vehicle, looks like new! Features a four cylinder engine, Holly four barrel carburetor, and air conditioning, Fleet maintained. Call Jim's Cars, 778-9253 after 6 pm on weekends."

In the staged advertisement, it is immaterial what is actually in the totality of the scripted ad, but it is important that the words and phrases are placed in an order having a similar position as they would be used in an actual voice advertisement. It is only required that it contain the new words and phrases in their proper syntactical position. For example, the model year, "1993" appears before the make of the vehicle "Edsel" and the body type immediately follows the make of the vehicle, etc. By using staged ads, the new words and phrases needed for voice advertisements of different vehicles can be scripted in a single script eliminating the need for making separate scripts for each vehicle and individual recordings by the voice talent. Further, by having the voice talent read staged scripts, the sentence structure is grammatically correct and improves the sound of the recordings.

Corresponding staged scripts for real estate or other goods can be made, recorded and edited as described above.

Special rules for the generation of numbers for the concatenation process can improve the voiced number playback. Each type of number uses a slightly different scheme for recording.

Phone numbers, for example, use at least seven categories, one set of 0–9 recordings for each of the seven positions of a seven digit phone number. The script would look like this:

| | | |
|---|---|---|
| 000 | 00 | 00 |
| 111 | 11 | 11 |
| 222 | 22 | 22 |
| ... | .. | .. |
| ... | .. | .. |
| ... | .. | .. |
| 888 | 88 | 88 |
| 999 | 99 | 99 |

The voice talent reads the first three numbers as one phrase, the next two numbers as a second phrase and the last two numbers as a third phrase. Thus, for telephone numbers, each number is read in every position which it may occur in a voice advertisement. This same technique may also be used for other numeral sequences, like catalog numbers, bank account numbers, etc. This process also is applicable to the letters of the alphabet where they also may be used in a fixed pattern or in certain combinations with numerals such as may be found on automobile license plates, serial numbers on appliances, credit cards, etc.

The invention has been disclosed with respect to a preferred embodiment. However, the invention is not to be so limited as changes and modifications may be made which are within the full intended scope of the invention as defined by the claims.

What is claimed is:

1. A method for producing a natural sounding voice file for an automated concatenation voice system comprising:

identifying new words to be entered into the voice file;

scripting a staged script in which the new words are formulated into sentences;

recording the staged script as read by a voice talent to generate digital voice data;

adjusting the amplitude of the digital voice data such that the amplitude of the words are substantially the same;

editing the adjusted digital voice data to identify each of the new words; and storing the new words into the voice file for use in the automated concatenation system.

2. The method of claim 1 wherein said voice file is a composite voice file for storing a plurality of words and phrases.

3. The method of claim 1 further including the step of practicing the reading of said staged script by the voice talent to assure that the reading of the staged script is natural and proper voice inflections are used.

4. The method of claim 1 wherein said step of scripting a staged script further includes the staging of the script using a computer program.

5. The method of claim 1 wherein said step of editing includes the step of editing in accordance with a predetermined set of rules.

6. The method of claim 1 further including the step of automatically playing back each new word in a voice message.

7. The method of claim 1 further including the step of offline testing of the new words together with words previously stored in the voice file in a similar situation as they will be used in said automated concatenation system.

8. The method of claim 1 wherein said automated concatenation system is an automated voice concatenation system for voice advertisements.

9. The method of claim 1 wherein the step of adjusting further comprises the steps of:

generating an average amplitude map of said digital voice data; and adjusting the amplitude of the digital voice data as a function of said average amplitude map.

10. A method for producing natural sounding voice files for an automated concatenation voice system comprising:

identifying new words or phrases to be entered into the voice file;

scripting a staged script in which the new words and phrases are formulated into real sentences;

recording the staged script as read by a voice talent to generate a composite recording;

processing the composite recording to increase clarity and to match words and phrases that are currently stored in the voice file;

precision editing of the composite recording to isolate and to assign an identification number to each of the new words and phrases; and storing the new words and phrases into the voice file for use in the automated concatenation system;

wherein said step of processing comprises the step of compressing words and phrases in the composite recording such that the amplitude of the words and phrases are substantially the same.

11. The method of claim 10 wherein said step of compressing comprises the step of peak amplitude clamping.

12. A method for producing natural sounding voice files for an automated concatenation voice system comprising:

identifying new words or phrases to be entered into the voice file;

scripting a staged script in which the new words and phrases are formulated into real sentences;

recording the staged script as read by a voice talent to generate a composite recording:

processing the composite recording to increase clarity and to match words and phrases that are currently stored in the voice file;

precision editing of the composite recording to isolate and to assign an identification number to each of the new words and phrases; and storing the new words and phrases into the voice file for use in the automated concatenation system;

wherein said step of editing includes the step of editing in accordance with a predetermined set of rules; and wherein said predetermined set of rules comprises:

a) reducing by 12 dB a breath sound of an isolated phrase when the isolated phrase is long enough for the voice talent to take a breath in the middle of the recording;

b) editing is to be made in the least conspicuous place;

c) editing is to be made as close as possible to a zero crossing of the sounding;

d) editing is to be made outside the word or phrase being edited;

e) editing from the end of one word or phrase to the beginning of the next word or phrase should attempt to keep a normal continuation of the velocity of the sound;

f) editing should be made approximately 0.02±0.005 seconds before the start of an isolated word or phrase; and g) editing should be made approximately 0.02±0.005 seconds after the end of a word or phrase.

13. The method of claim 12 wherein said step of editing to keep a normal continuation of the velocity of the sound further comprises:

editing the beginnings of a word or phrase at a zero crossing and going in the zero to positive direction;

editing the ends of a word or phrase at a zero crossing and going in the negative to zero direction.

14. The method of claim 12 wherein said step of editing 0.02±0.005 seconds before the word or phrase for a fricative sound is made approximately at the beginning of the fricative sound, and wherein said step of editing 0.02±0.005 seconds after a word or phrase for a fricative sound is made approximately at the ending of the fricative sound.

15. A system for producing natural sounding concatented voice files for an automated concatenation system comprising:

means for converting a voiced sound to digital voice data;

a digital data storage for storing the digital voice data;

a generator for generating an average amplitude map of said digital voice data stored in the digital data storage;

a peak amplitude clamping processor to adjust the amplitude of the digital voice data to a predetermined target level using said average amplitude map such that each word and syllable has approximately the same amplitude;

a word and phrase editor for identifying words or phrases in said digital voice data and assigning them individual identification numbers;

a voice file for storing the words and phrases identified by the word and phrase editor.

16. The system of claim 15 further including an off-line test system for testing the edited words and phrases together with words and phrases stored in the voice file prior to storing the edited words and phrases in the voice file.

17. The system of claim 15 wherein said voice file is a composite voice file storing a plurality of words and phrases.

* * * * *